US011551621B2

(12) United States Patent
Kim et al.

(10) Patent No.: US 11,551,621 B2
(45) Date of Patent: Jan. 10, 2023

(54) ELECTROLUMINESCENCE DISPLAY DEVICE AND METHOD FOR SENSING DEGRADATION OF A LIGHT EMITTING ELEMENT INCLUDED IN THE SAME

(71) Applicant: LG Display Co., Ltd., Seoul (KR)

(72) Inventors: Daehun Kim, Gyeongsangbuk-do (KR); DongYoup Shin, Incheon (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/347,216

(22) Filed: Jun. 14, 2021

(65) Prior Publication Data

US 2022/0148517 A1 May 12, 2022

(30) Foreign Application Priority Data

Nov. 12, 2020 (KR) ..... 10-2020-0151047

(51) Int. Cl.

| | |
|---|---|
| ***G09G 3/3291*** | (2016.01) |
| ***G09G 3/3233*** | (2016.01) |
| ***G09G 3/3208*** | (2016.01) |
| ***G09G 3/3225*** | (2016.01) |

(52) U.S. Cl.

CPC ..... *G09G 3/3291* (2013.01); *G09G 2310/08* (2013.01); *G09G 2320/0233* (2013.01)

(58) Field of Classification Search

CPC ..... G09G 2310/0289; G09G 2330/028; G09G 2320/043; G09G 2320/045

See application file for complete search history.

(56) References Cited

U.S. PATENT DOCUMENTS

| | | | | |
|---|---|---|---|---|
| 2004/0041763 | A1* | 3/2004 | Kodama | G09G 3/3688 345/87 |
| 2010/0117937 | A1* | 5/2010 | Kim | G09G 3/3233 345/76 |
| 2014/0002438 | A1* | 1/2014 | Higashi | G09G 3/3688 345/212 |
| 2014/0091994 | A1* | 4/2014 | Lin | G09G 3/348 345/87 |
| 2016/0086544 | A1* | 3/2016 | Park | G09G 3/3233 345/82 |
| 2016/0247450 | A1* | 8/2016 | Liu | G09G 3/3258 |
| 2016/0314741 | A1* | 10/2016 | Yin | G09G 3/3225 |
| 2016/0343341 | A1* | 11/2016 | Kwak | G09G 3/3677 |
| 2017/0140707 | A1* | 5/2017 | Xu | G09G 3/3258 |
| 2018/0151112 | A1* | 5/2018 | Song | G09G 3/3291 |
| 2020/0074930 | A1* | 3/2020 | Lee | G09G 3/3258 |
| 2020/0193903 | A1* | 6/2020 | Park | G09G 3/3233 |
| 2020/0394968 | A1* | 12/2020 | Kwon | G09G 3/3291 |

* cited by examiner

*Primary Examiner* — Sepehr Azari

(74) *Attorney, Agent, or Firm* — Fenwick & West LLP

(57) ABSTRACT

The present disclosure relates to an electroluminescence display device including a display panel including a pixel driving circuit and a light emitting element, a power supply circuit for generating a logic voltage to be applied to the pixel driving circuit, and a timing controller for supplying a voltage control signal to the power supply circuit. The power supply circuit may include a power IC, a booster circuit, and a voltage regulator. In the electroluminescence display device, degradation noise of the pixel can be reduced, and thereby, the image quality of the display panel can be improved.

13 Claims, 11 Drawing Sheets

ELECTROLUMINESCENCE DISPLAY DEVICE AND METHOD FOR SENSING DEGRADATION OF A LIGHT EMITTING ELEMENT INCLUDED IN THE SAME

CROSS-REFERENCE TO RELATED APPLICATION

This application claims the priority benefit of Republic of Korea Patent Application No. 10-2020-0151047, filed on Nov. 12, 2020 in the Korean Intellectual Property Office, the disclosure of which is incorporated herein by reference in its entirety.

BACKGROUND

Technical Field

The present disclosure relates to electroluminescence display devices, and more specifically, to an electroluminescence display device including a power supply circuit for generating a voltage to be applied to a pixel driving circuit.

Description of the Related Art

Electroluminescence display devices may be classified into an inorganic light emitting display device and an organic light emitting display device based on a material of an associated emission layer. The organic light emitting display device of an active matrix type includes an organic light emitting diode with a self-emitting property, and has an advantage of a short response time, high luminous efficiency, excellent luminance, a wide viewing angle, and the like.

The organic light emitting display device reproduces input images using a self-emitting element such as an organic light emitting diode. The organic light emitting display device typically includes an anode electrode, a cathode electrode, and an organic compound layer interposed between the anode electrode and the cathode electrode. The organic compound layer includes a hole injection layer, a hole transport layer, an emission layer, an electron transport layer, and an electron injection layer. When voltages are applied to the anode and cathode electrodes, holes passing through the hole transport layer and electrons passing through the electron transport layer can move to the emission layer to form excitons, and as a result, the emission layer can generate visible light.

Such a display device includes a pixel driving circuit for supplying a current to the organic light emitting diode so that the emission layer can emit light. The pixel driving circuit can supply a desired current to the organic light emitting diode by receiving a data signal, a gate signal, an emission signal, and the like. In order to enable the organic light emitting diode to emit light with desired luminance over time, it is required to provide robust reliability of the pixel driving circuit. In general, the pixel driving circuit may be implemented as an internal compensation circuit or an external compensation circuit. A degree of degradation of each pixel over time becomes different according to a time period for which the display device has been in use, target luminance, and the like. For this reason, the pixel driving circuit is implemented as a circuit capable of compensating for the degradation of the pixel over time. In order for a pixel to emit light that is constant and meets the target luminance, the performance of the pixel is determined by how accurately the pixel driving circuit compensates for a degree to which the pixel is degraded over time. However, noises may occur in the process of sensing and compensating for the degree of degradation due to the influence of elements included in the pixel driving circuit. This eventually leads to the pixel not emitting light with desired luminescence, and causes a problem that the display quality of the display device is deteriorated.

SUMMARY

To address these issues, embodiments of present disclosure provide electroluminescence display devices with improved reliability by including a power supply circuit for reducing sensing noises in a pixel driving circuit.

Issues or problems for solving in the present disclosure are not limited thereto, and other issues or problems will become apparent to those skilled in the art from the following description.

In accordance with aspects of the present disclosure, an electroluminescence display device is provided that includes a display panel in which at least one pixel including a pixel driving circuit and a light emitting element is disposed, a power supply circuit for generating a logic voltage to be applied to the pixel driving circuit, and a timing controller for supplying a voltage control signal to the power supply circuit. Here, the power supply circuit includes a power IC, a booster circuit, and a voltage regulator. In the electroluminescence display device, degradation noises of the pixel can be reduced, and thereby, the image quality of the display panel can be improved.

Various specific features, configurations, techniques and processes are included in detailed description and the accompanying drawings, and will be discussed in detail below.

In accordance with aspects of the present disclosure, as the electroluminescence display panel includes the power supply circuit for regulating a logic voltage to be applied to the pixel driving circuit, degradation noises of light emitting elements can be reduced, and thereby, the image quality of the display panel can be improved.

In accordance with aspects of the present disclosure, as the power supply circuit includes the voltage regulator including one or more resistors and a circuit portion, and a feedback voltage can be supplied from the voltage regulator to the power IC, degradation noises of light emitting elements can be reduced, and thereby, the image quality of the display panel can be improved.

Issues required to be addressed, embodiments for addressing the issues, effects resulting from the embodiments, which are described above and below, are not intended to specify essential features of claims, and thus, the claims are not intended to be limited to the particular features described in the present disclosure.

DETAILED DESCRIPTION

Figure 1:
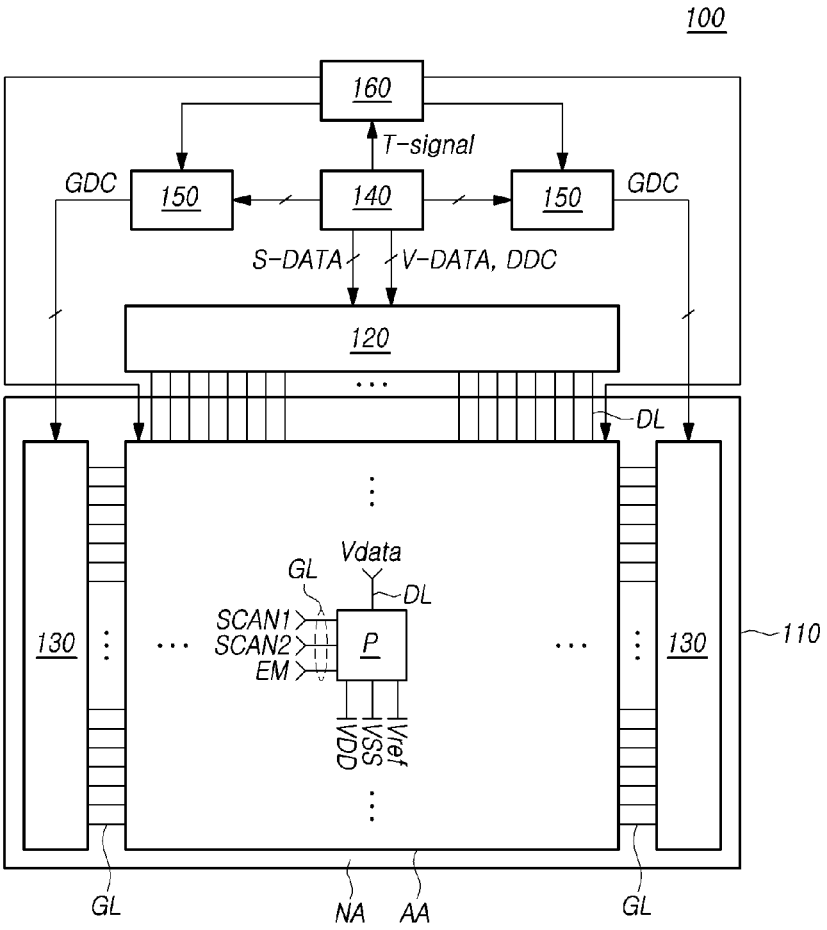
FIG. 1 is a block diagram illustrating an electroluminescence display device according to aspects of the present disclosure.

The advantages and features of the present disclosure and methods of achieving the same will be apparent by referring to embodiments of the present disclosure as described below in detail in conjunction with the accompanying drawings. However, the present disclosure is not limited to the embodiments set forth below, but may be implemented in various different forms. The following embodiments are provided only to completely disclose the present disclosure and inform those skilled in the art of the scope of the present disclosure, and the present disclosure is defined only by the scope of the appended claims.

In addition, the shapes, sizes, ratios, angles, numbers, and the like illustrated in the accompanying drawings for describing the exemplary embodiments of the present disclosure are merely examples, and the present disclosure is not limited thereto. Like reference numerals generally denote like elements throughout the present specification. Further, in the following description of the present disclosure, detailed description of well-known functions and configurations incorporated herein will be omitted when it is determined that the description may make the subject matter in some embodiments of the present disclosure rather unclear. The terms such as "including", "having", "containing", "comprising of", and "consist of" used herein are generally intended to allow other components to be added unless the terms are used with the term "only". Singular forms used herein are intended to include plural forms unless the context clearly indicates otherwise.

In interpreting any elements or features of the embodiments of the present disclosure, it should be considered that any dimensions and relative sizes of layers, areas and regions include a tolerance or error range even when a specific description is not conducted.

Spatially relative terms, such as, "on", "over", "above", "below", "under", "beneath", "lower", "upper", "near", "close", "adjacent", and the like, may be used to describe one element or feature's relationship to another element(s) or feature(s) as illustrated in the figures, and it should be interpreted that one or more elements may be further "interposed" between the elements unless the terms such as "directly", "only" are used.

Time relative terms, such as "after", "subsequent to", "next to", "before", or the like, used to describe a temporal relationship between events, operations, or the like are generally intended to include events, situations, cases, operations, or the like that do not occur consecutively unless the terms, such as "directly", "immediately", or the like, are used.

When the terms, such as "first", "second", or the like, are used to describe various elements or components, it should be considered that corresponding elements or components are not limited to the meaning of these terms. That is, these terms are merely used for distinguishing an element or component from one or more other elements or components. Therefore, a first element mentioned below may be a second element within a technical concept of the present disclosure.

Like reference numerals generally denote like elements throughout the present specification.

The elements or features of various exemplary embodiments of the present disclosure can be partially or entirely bonded to or combined with each other and can be interlocked and operated in technically various ways as can be fully understood by a person having ordinary skill in the art, and the various exemplary embodiments can be carried out independently of or in association with each other.

Hereinafter, an electroluminescence according to aspects of the present disclosure will be discussed with reference to accompanying drawings.

FIG. 1 is a block diagram illustrating the electroluminescence display device according to aspects of the present disclosure.

The electroluminescence display device 100 includes a display panel 110, one or more display panel drivers (a data driver 120 and a gate driver 130) for supplying signals to the display panel 110, a timing controller 140, at least one level shifter 150, and a power supply circuit 160. The display panel 110 includes an active area AA and a non-active area NA, and an array of pixels is arranged in the active area AA. The array of pixels includes one or more data lines DL, one or more gate lines GL intersecting the one or more data lines DL, and one or more sub-pixels each arranged in an area where the data line DL and the gate line GL intersect.

Each pixel includes one or more sub-pixels P each emitting light with a different color from one another for representing colors, and each sub-pixel P includes at least one transistor used as a switching element or a driving element. Such a transistor may be a thin film transistor. Each pixel may include a red sub-pixel, a green sub-pixel, and a blue sub-pixel. In another embodiment, each pixel may further include a white sub-pixel.

Each sub-pixel P may include a pixel driving circuit and a light emitting element. The pixel driving circuit may include one or more thin film transistors and at least one capacitor. The pixel driving circuit is electrically connected to the data line DL and the gate line GL.

Different signals according to types in which pixel driving circuit are implemented may be applied to the sub-pixel. A data voltage Vdata is applied to a pixel driving circuit according to embodiments described herein through a data line DL. A first scan signal SCAN1, a second scan signal SCAN2, and an emission signal EM are applied to the pixel driving circuit through the gate lines GL. A high power supply voltage VDD, a low power supply voltage VSS, and a reference voltage Vref are applied to the pixel driving circuit through power lines.

The electroluminescence display device 100 according to aspects of the present disclosure may include a display panel driving circuit for supplying data signals and gate signals to the display panel 110. The display panel driving circuit may include a data driver 120 and a gate driver 130. The display panel driving circuit can enable data of input images to be written to sub-pixels P of the display panel 110 by control of timing controller 140. The gate driver 130 can supply gate signals to gate electrodes of transistors included in each sub-pixel P, and thereby, control turn-on and turn-off of the transistors.

The electroluminescence display device 100 generally writes data to the sub-pixels P using a progressive scan scheme. In the progressive scan scheme, data are sequentially written to all lines of the active area AA during a vertical active period of 1 frame period. For example, after data are simultaneously written to sub-pixels P arranged in a first row, data are simultaneously written to sub-pixels P arranged in a second row, and then data are simultaneously written to sub-pixels P arranged in a third row. In this manner, data are sequentially written row by row to sub-pixels arranged in all rows included in the display panel 110. In order to implement such a progressive scan scheme, the gate driver 130 can sequentially supply gate signals to the gate lines GL by shifting an output signal using the shift register.

The data driver 120 can output data voltages to be supplied to all sub-pixels P of the display panel 110 within the vertical active period. When the display panel 110 is implemented with multiple arrays of pixels including N columns and M rows, the display panel 110 may include N data lines DL. The data voltage may include a video data voltage for display and a data voltage for sensing. The video data voltage for display is a data voltage of an input image. The data voltage for sensing is a data voltage for sensing electrical characteristics of a sub-pixel P. The data voltage for sensing may be a preset specific voltage regardless of data of an input image.

The gate driver 130 may be disposed in a non-active area NA of the display panel 110, in which an image is not displayed. The gate driver 130 may be directly disposed on a same substrate together with the pixel driving circuits of the active area AA serving as a display screen. The gate driver 130 can select sub-pixels P for charging data voltages through the gate lines GL by supplying gate signals according to the control of the timing controller 140. The gate driver 130 can output one or more gate signals using one or more shift registers and shift the one or more gate signals.

The timing controller 140 can receive digital video data of an input image and a timing signal synchronized therewith from a host system. The timing signal may include a vertical synchronization signal, a horizontal synchronization signal, a clock signal, a data enable signal, and the like. The host system may be any one of a TV, a set-top box, a navigation system, a personal computer, a home theater, a mobile device, a home electronic product, a wearable device, and the like.

The timing controller 140 can supply a data timing control signal DDC for controlling an operation timing of the data driver 120, and a gate timing control signal GDC for controlling an operation timing of the gate driver 130, based on a timing signal received from the host system. The timing controller 140 can supply a voltage control signal T-signal for controlling a voltage level of a gate signal supplied to the display panel 110 by being generated from the power supply circuit 160.

The level shifter 150 converts a voltage of the gate timing control signal GDC supplied from the timing controller 140 into a gate-on voltage and a gate-off voltage, and supplies the converted voltages to the gate driver 130. A low level voltage of the gate timing control signal GDC is converted to a gate low voltage, and a high level voltage of the gate timing control signal GDC is converted to a gate high voltage, by the gate driver 130.

When the pixel driving circuit operates in normal operation, the power supply circuit 160 can provide a gate low voltage and a gate high voltage to the level shifter 150 without the control of the timing controller 140. When the pixel driving circuit operates in sensing operation, the power supply circuit 160 can control magnitudes or levels of a gate low voltage and a gate high voltage to be generated by the level shifter 150 according to a voltage control signal T-signal of the timing controller 140. Further, the power supply circuit 160 can supply a high power supply voltage VDD, a low power supply voltage VSS, and a reference voltage Vref to sub-pixels P disposed in the display panel 110.

In the case of an n-type thin film transistor, a gate-on voltage is a gate high voltage, and a gate-off voltage is a gate low voltage. In the case of a p-type thin film transistor, a gate-on voltage is a gate low voltage, and a gate-off voltage is a gate high voltage.

The gate timing control signal GDC may include a start pulse, a clock, and the like. The start pulse is generated once at an initial time of one frame period every frame and is input to the gate driver 130. The start pulse controls a start timing of the gate driver 130 every frame. The clock controls a shift timing of a gate signal output from the gate driver 130.

The start pulse, the clock signal, and the like supplied from the gate driver 130 to sub-pixels P may be implemented as waveforms converted to the gate low voltage or the gate high voltage.

The data driver 120, the timing controller 140, the level shifter 150, and the power supply circuit 160 may be included in one driving integrated circuit.

Figure 2:
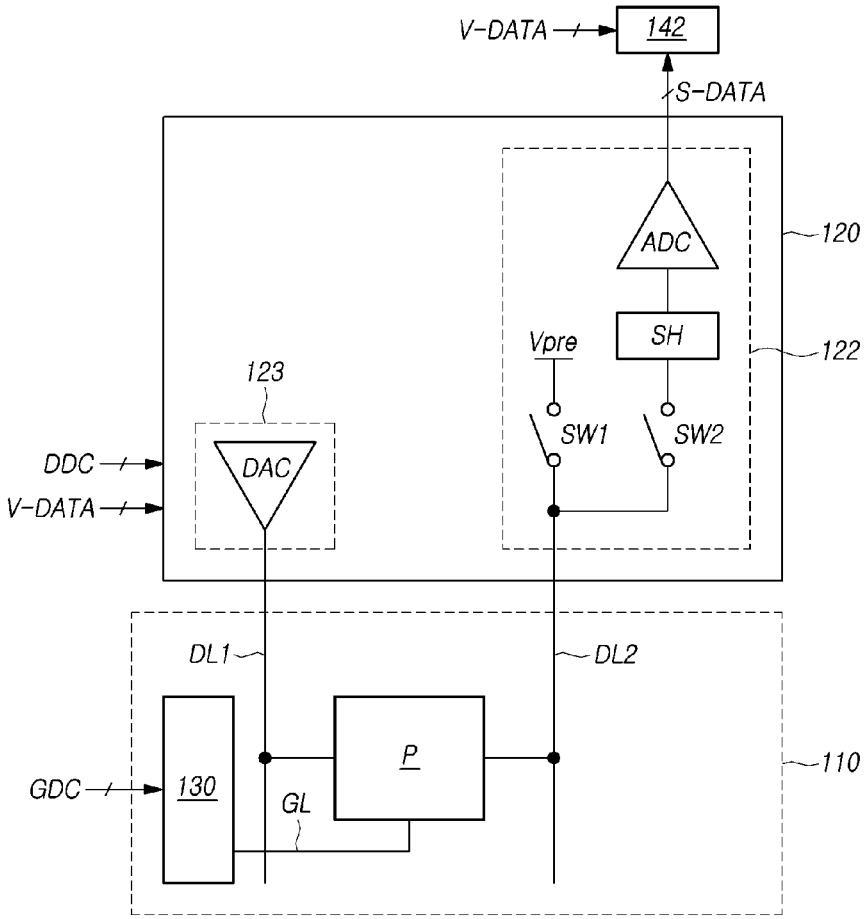
FIG. 2 illustrates a sensing path in a sub-pixel according to aspects of the present disclosure.

FIG. 2 illustrates a sensing path running in a sub-pixel P according to aspects of the present disclosure.

The sub-pixels P include a light emitting element EL and a pixel driving circuit. The pixel driving circuit can sense and compensate for a degree to which all or each of a driving element and the light emitting element are degraded. For example, the degradation of the driving element may be the degradation of a threshold voltage or mobility characteristic of the driving element, and the degradation of the light emitting element may be the degradation of a threshold voltage for enabling the light emitting element to emit light. The pixel driving circuit can sense and compensate for the degradation of the driving element and the light emitting element through one or more elements included in the pixel driving circuit. At least one driver disposed in non-active area NA or outside of the display panel 110 is used to sense and compensate for the degradation of the light emitting element. Accordingly, a method of sensing and compensating for the degradation of characteristics of a light emitting element will be described with reference to FIGS. 2 and 3.

Referring to FIG. 2, the data driver 120 may include a sensing circuit 122 for sensing at least one circuit element or a light emitting element included in a pixel or sub-pixel and a data voltage generator 123. A sensing path for sensing at least one circuit element or a light emitting element may include one or more data lines (DL1, DL2) connected to the sub-pixel P, one or more switch elements (SW1, SW2), a sample & hold circuit SH, an analog-to-digital converter ADC, a digital-to-analog converter DAC, and the like.

The data voltage generator 123 can generate a data voltage through the digital-to-analog converter DAC, and then, supply the generated data voltage to a first data line DL1. When a gate signal synchronized with the data voltage is supplied to a corresponding gate line GL, the data voltage is supplied to the sub-pixel P. The data voltage includes a data voltage for display and a data voltage for sensing.

The sensing circuit 122 may be electrically connected to the sub-pixel P through a second data line DL2. The sensing circuit 122 may include the sample and hold circuit SH, the analog-to-digital converter ADC, a first switch element SW1, and a second switch element SW2. The sensing circuit 122 can sense electrical characteristics of the light emitting element EL by sampling a current or voltage in the second data line DL2 that varies according to a current flowing through the light emitting element EL. The first switch element SW1 can supply a predetermined charging voltage Vpre to the second data line DL2 to initialize and charge a sub-pixel P and the second data line DL2. The second switch element SW2 can be turned on when a specific gate line is held for a predetermined sensing time and then connect the second data line DL2 to the sample and hold circuit SH. One or more target sub-pixels P to be sensed are connected to a specific gate line. The selection of a specific gate line may be changed every frame period or every predetermined time so that all sub-pixels P included in the display panel 110 can be sensed.

The sample and hold circuit SH can sample and hold an analog sensing voltage of the sub-pixel P charged in the second data line DL2. The analog-to-digital converter ADC can convert the analog sensing voltage of the sub-pixel P sampled by the sample and hold circuit SH into digital sensing data S-DATA. The sensing circuit 122 may be implemented as a typical voltage sensing circuit or current sensing circuit. The digital sensing data S-DATA output from the sensing circuit 122 can be transmitted to a compensation circuit 142 of the timing controller 140.

The compensation circuit 142 can modulate video data V-DATA of an input image by adding or multiplying a compensation value preset in a look up table to the video data V-DATA according to the sensing value of the sub-pixel P, and thereby, the compensation circuit 142 can compensate for a variance in electrical characteristics of the sub-pixel. The lookup table can receive a memory address corresponding to the digital sensing data S-DATA and the video data V-DATA of the input image, and then, output a compensation value stored at this address. The video data V-DATA modulated by the compensation circuit 142 can be transmitted to the data voltage generator 123. The modulated video data V-DATA can be converted into a data voltage for display by the data voltage generator 123, and then supplied to the first data line DL1

The sensing value sensed through the second data line DL2 may also be used for adjusting a magnitude or strength of a gate signal input to a pixel driving circuit, and a detailed description thereof will be described later.

A connection relationship between the first data line DL1 and the second data line DL2 is not limited to the embodiment shown in FIG. 2. For example, the sensing circuit 122 may supply a video data voltage of an input image to the second data line DL2, and a predetermined charging voltage Vpre may be applied through the first data line DL2.

Hereinafter, a method of sensing and compensating for the degradation of characteristics of a driving element will be described.

Figure 3A:
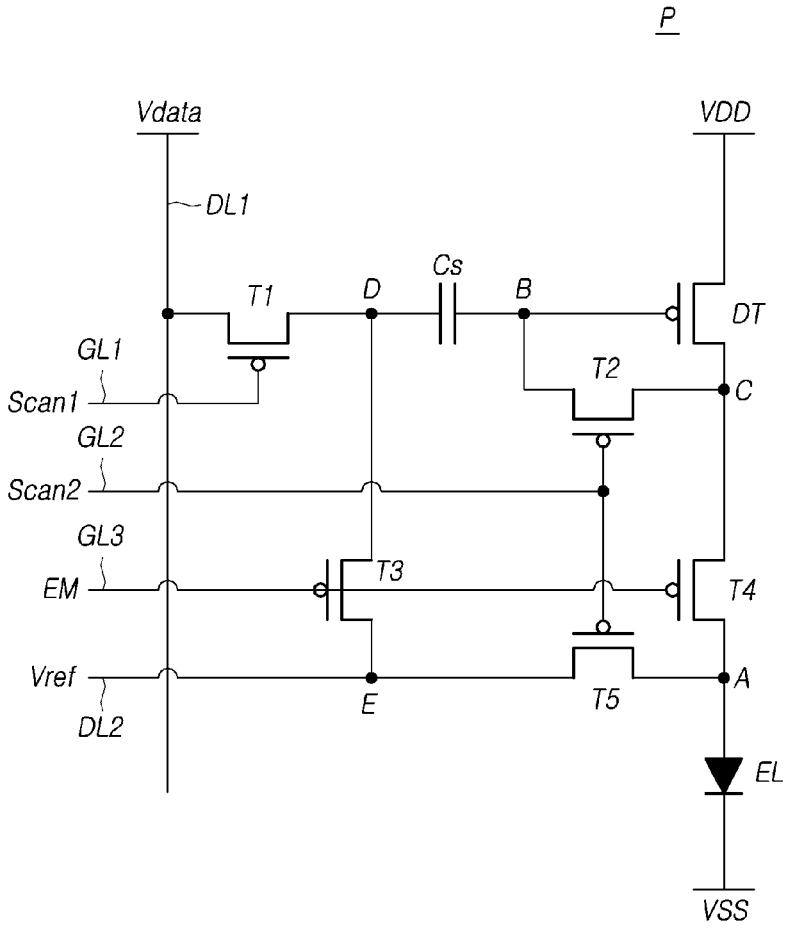
FIG. 3A illustrates a pixel driving circuit included in a sub-pixel according to aspects of the present disclosure.
Figure 3B:
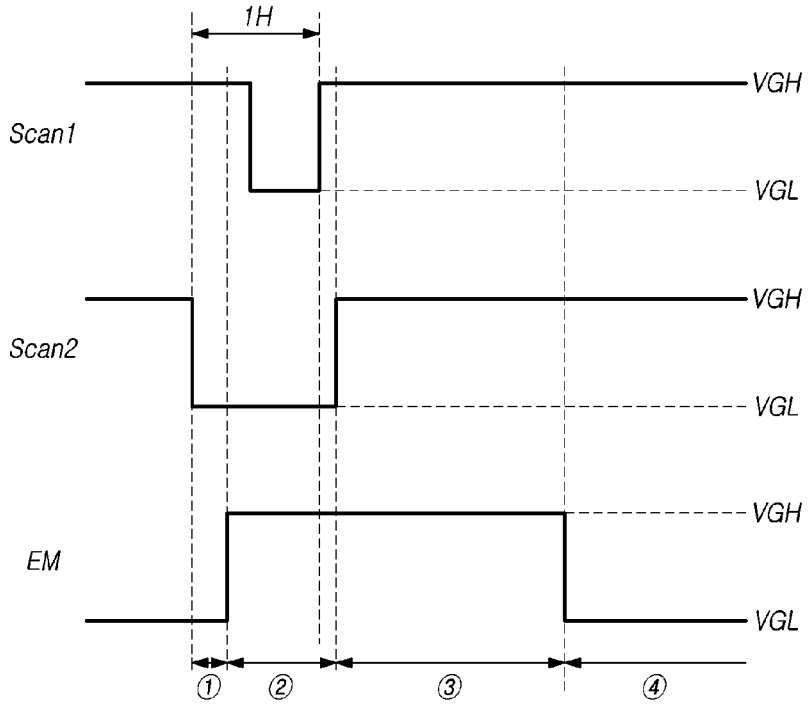
FIG. 3B illustrates waveforms of signals applied to the pixel driving circuit shown in FIG. 3A according to aspects of the present disclosure.

FIG. 3A illustrates a pixel driving circuit included in a sub-pixel P according to aspects of the present disclosure. FIG. 3B illustrates waveforms of signals applied to the pixel driving circuit shown in FIG. 3A according to aspects of the present disclosure.

Referring to FIGS. 3A and 3B, the sub-pixel P includes a light emitting element EL and a pixel driving circuit, and the pixel driving circuit includes a driving element DT, a first transistor T1, a second transistor T2, a third transistor T3, a fourth transistor T4, a fifth transistor T5, and a capacitor Cs. The driving element DT may be a driving transistor.

The light emitting element EL emits light by a driving current supplied from the driving element DT. An organic compound layer including multiple layers is formed between anode and cathode electrodes of the light emitting element EL. The anode electrode of the light emitting element EL may be connected to node A, and the cathode electrode of the light emitting element EL may be connected to a low power supply line for supplying a low power supply voltage VSS. The low power supply line may be a line running in one direction, or have a plate shape that is disposed on or over a substrate, includes a hole, and is widely formed.

The driving element DT can control a driving current flowing through the light emitting element EL according to a source-gate voltage of the driving element DT. A gate electrode of the driving element DT may be connected to node B, and source and drain electrodes of the driving element DT may be connected to a high power supply line for supplying a high power supply voltage VDD and node C, respectively. The source and drain electrodes of the driving element DT may be interchangeable according to types of the driving transistors. FIG. 3A illustrates that the pixel driving circuit is implemented with p-type transistors; however, embodiments of the present disclosure are not limited thereto.

The first transistor T1 may be connected to a first data line DL1 and node D, and a gate electrode of the first transistor T1 may be connected to a first gate line GL1. The first transistor T1 may be turned on by a first scan signal Scant and transmit a data voltage Vdata to node D. The first scan signal Scant may be supplied through the first gate line GL1.

The second transistor T2 may be connected to node B and node C, and a gate electrode of the second transistor T2 may be connected to a second gate line GL2. The second transistor T2 may be turned on by a second scan signal Scan2 and connect between node B and node C. The second scan signal Scan2 is supplied through the second gate line GL2.

The third transistor T3 may be connected to a second data line DL2 and node D, and a gate electrode of the third transistor T3 may be connected to a third gate line GL3. The third transistor T3 may be turned on by an emission signal EM and transmit a reference voltage Vref to node D. The emission signal EM may be supplied through the third gate line GL3 and the reference voltage Vref may be supplied through the second data line DL2. When the display panel 110 operates in normal operation, the reference voltage Vref may be supplied to the second data line DL2 differently from when the display panel 110 operates in sensing operation.

The fourth transistor T4 may be connected to node C and node A, and a gate electrode of the fourth transistor T4 may be connected to the third gate line GL3. The fourth transistor T4 may be turned on by the emission signal EM and connect between node C and node A.

The fifth transistor T5 may be connected to the second data line DL2 and node A, and a gate electrode of the fifth transistor T5 may be connected to the second gate line GL2. The fifth transistor T5 may be turned on by the second scan signal Scan2 and transmit the reference voltage Vdata to node A.

The pixel driving circuit can generate a driving current for allowing the light emitting element EL to emit light, and perform a compensation process for compensating for degradation of the driving element DT caused in the light emitting process. The driving of the pixel driving circuit includes an initialization period ①, a sampling period ②, a holding period ③, and a light emission period 4. The first scan signal Scan1 and the second scan signal Scan2 supplied to the pixel driving circuit may represent a gate low voltage VGL for turning on a transistor as a pulse of about 1 horizontal period 1H within one frame, and a gate high voltage VGH in the remaining period of the one frame. Specifically, the gate low voltage VGL pulse of the first scan signal Scan1 may be shorter than 1 horizontal period 1H, and the gate low voltage VGL pulse of the second scan signal Scan2 may be longer than 1 horizontal period 1H. Further, the gate low voltage VGL pulse of the first scan signal Scan1 may completely overlap the gate low voltage VGL pulse of the second scan signal Scan2. The emission signal EM supplied to the pixel driving circuit may represent a gate high voltage VGH for turning off a transistor as a pulse of about 3 horizontal periods 3H, and a gate low voltage VGL in the remaining period of the one frame. The gate high voltage VGH pulse of the emission signal EM may completely overlap the gate low voltage VGL pulse of the first scan signal Scan1, and may partially overlap the gate low voltage VGL pulse of the second scan signal Scan2.

The first scan signal Scan1 and the second scan signal Scan2 may be output from different scan drivers included in the gate driver 130, and the emission signal EM may be output from an emission driver included in the gate driver 130.

The initialization period ① may start when the second scan signal Scan2 is switched from the gate high voltage VGH to the gate low voltage VGL. During the initialization period (1), the emission signal EM may maintain the gate low voltage VGL, and the first scan signal Scan1 may maintain the gate high voltage VGH.

As the fifth transistor T5 is turned on by the second scan signal Scan2, a reference voltage Vref can be supplied to the anode of the light emitting element EL. Thereby, an anode voltage can be reset to the reference voltage Vref. As the fourth transistor T4 is turned on by the emission signal EM, the anode of the light emitting element EL and the drain of the driving transistor DT can be electrically connected. As the second scan signal Scan2 is switched to the gate low voltage VGL, the reference voltage Vref can be supplied to the drain of the driving transistor DT. As the second transistor T2 is turned on by the second scan signal Scan2, the gate and drain of the driving transistor DT can be electrically connected, and the reference voltage Vref can be supplied to the gate of the driving transistor DT. Thus, the gate and drain of the driving transistor DT and the anode of the light emitting element EL can be electrically connected and reset to the reference voltage. In this instance, the reference voltage Vref may be a voltage lower than the high power supply voltage VDD and higher than the low power supply voltage VSS.

As the third transistor T3 is turned on by the emission signal EM, the reference voltage Vref can be supplied to node D, and thereby, one electrode of the capacitor Cs can maintain the reference voltage Vref. Accordingly, as the reference voltage Vref is supplied to both electrodes of the capacitor Cs, a capacitance across the capacitor Cs becomes zero.

The sampling period ② may start when the emission signal EM is switched from the gate low voltage VGL to the gate high voltage VGH. The second scan signal Scan2 may maintain the gate low voltage VGL, and the first scan signal Scan1 may be switched to the gate low voltage VGL. The first scan signal Scan1 may be a gate low voltage VGL pulse within the sampling period ②.

The third transistor T3 and the fourth transistor T4 can be turned off by the emission signal EM, and the second transistor T2 and the fifth transistor T5 can maintain the turn-on state by the second scan signal Scan2. Thus, as the driving transistor DT enters a diode-connected state, a gate voltage of the driving transistor DT can increase. The increasing of the gate voltage of the driving transistor DT may stop when the gate voltage reaches a difference between a source voltage of the driving transistor DT and a threshold voltage of the driving transistor DT. In this manner, the threshold voltage of the driving transistor DT can be sampled during the sampling period ②.

Further, the first transistor T1 can be turned on by the first scan signal Scant, and thus, a data voltage Vdata can be applied to node D. The data voltage Vdata can affect node B due to the coupling effect of the capacitor Cs. Accordingly, the gate voltage of the driving transistor DT equals (VDD-Vth-Vdata). Here, Vth is the threshold voltage of the driving transistor DT.

The initialization period (①) and the sampling period (②) may proceed for about 1 horizontal period (1H), and a ratio of the initialization period (①) and the sampling period (②) may be about 1:9 to allow the threshold voltage compensation to proceed smoothly.

The holding period ③ may start when the second scan signal Scan2 is switched from the gate low voltage VGL to the gate high voltage VGH. As the holding period (③) includes one horizontal period (1H) or more, by turning off all transistors after the charging of the capacitor Cs, the charged voltage can be stabilized. The first scan signal Scant and the emission signal EM may maintain the gate high voltage VGH.

In the holding period (③), the first transistor T1, the second transistor T2, the third transistor T3, the fourth transistor T4, the fifth transistor T5, and the driving transistor DT can be turned off.

The light emission period ④ may start when the emission signal EM is switched from the gate high voltage VGL to the gate low voltage VGH. The first scan signal Scant and the second scan signal Scan2 may maintain the gate high voltage VGH.

The third transistor T3 can be turned on by the emission signal EM, and the reference voltage Vref can be applied to node D. Accordingly, a voltage at node B equals (VDD−Vth−(Vdata−Vref)) due to the coupling effect of the capacitor Cs. The driving transistor DT can supply a driving current ID by the voltage at node B. The fourth transistor T4 can be turned on by the emission signal EM, and thus, the driving transistor DT and the light emitting element EL can be electrically connected. In this instance, the driving current ID flowing through the light emitting element EL is determined by the reference voltage Vref and the data voltage Vdata as the threshold voltage Vth is compensated. The driving current ID can be described as Equation 1.

$$ID = \frac{k}{2}(Vdata - Vref)^2 \quad \text{[Equation 1]}$$

where k represents a constant value for characteristics of the driving transistor DT. Referring to Equation 1, since the threshold voltage Vth of the driving transistor DT is removed in the driving current ID, the driving current ID does not depend on the threshold voltage Vth of the driving transistor DT, and is not affected by a change in the threshold voltage Vth.

Figure 4A:
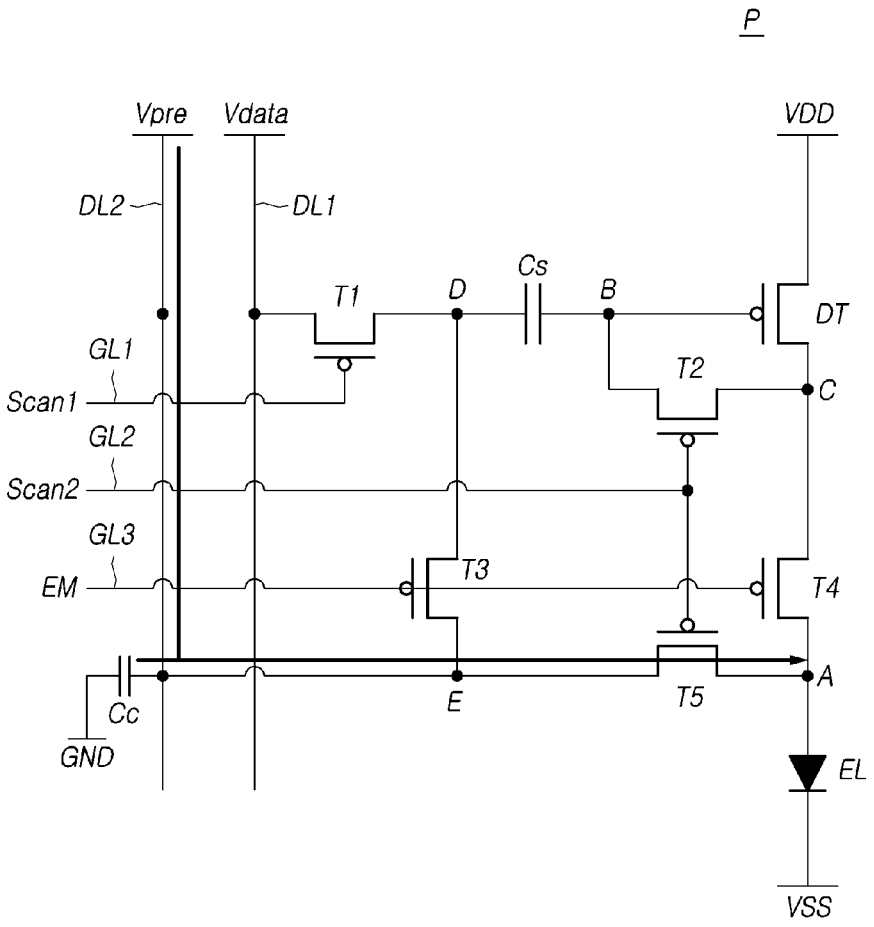
FIGS. 4A and 4B illustrate operations for sensing a sub-pixel according to aspects of the present disclosure.
Figure 4B:
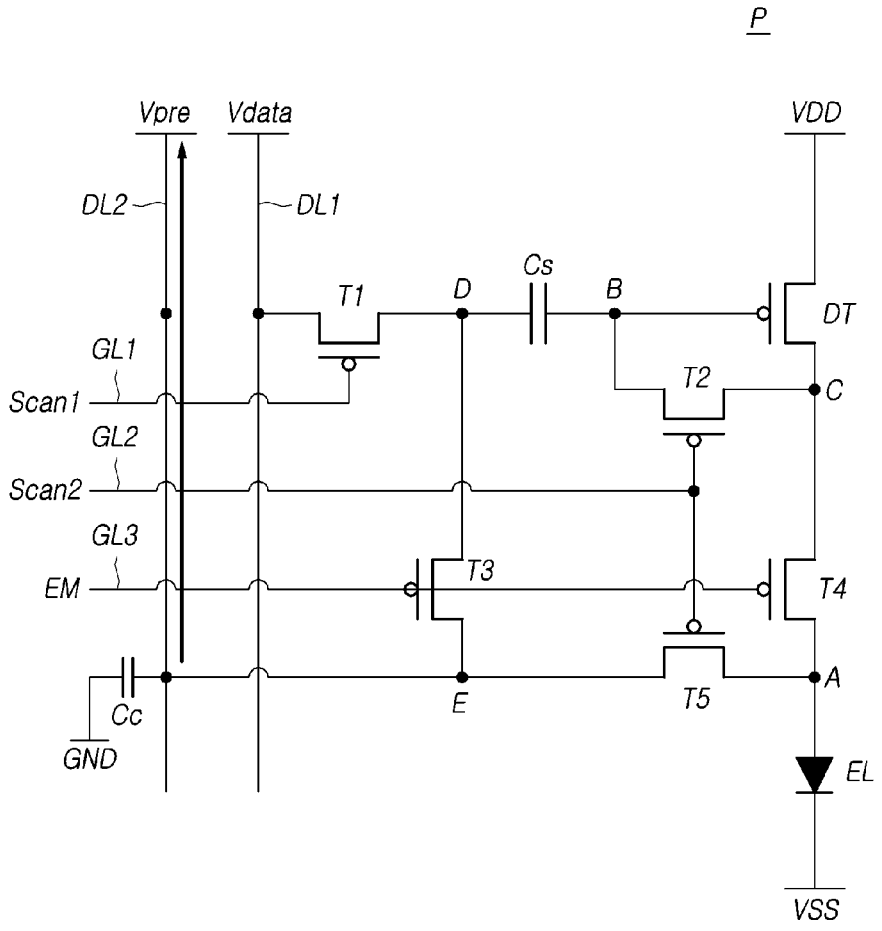

FIGS. 4A and 4B illustrate operations for sensing a sub-pixel P according to aspects of the present disclosure. Through this operation, a degree to which the sub-pixel P is degraded can be sensed, and in particular, the degradation of a light emitting element EL can be sensed. Pixel driving circuits of FIGS. 4A and 4B are equal to the pixel driving circuit shown in FIG. 3A. In FIGS. 4A and 4B, the second data line DL2 for supplying the reference voltage Vref is further illustrated in more detail.

Degradation sensing of a light emitting element EL is performed in sensing operation, while not being performed in normal operation. The sensing driving may be performed in a blank period between frame periods.

FIG. 4A illustrates a step of enabling the anode of a light emitting element EL to be charged, such as an organic light emitting diode, and FIG. 4B illustrates a step of sensing a voltage at the anode of the light emitting element EL.

Referring to FIG. 4A, in a sensing driving period, the fifth transistor T5 may be turned on by the second scan signal SCAN2. A charging voltage Vpre can be supplied to the anode of the light emitting element EL through the operation of the fifth transistor T5. The charging voltage Vpre is a voltage different from the reference voltage Vref described above, and is lower than the high power supply voltage VDD and higher than the low power supply voltage VSS and the reference voltage Vref. Referring to FIG. 2, the charging voltage Vpre can be supplied to the second data line DL2 by turning on the first switch element SW1. The charging voltage Vpre can be transmitted to the anode of the light emitting element EL and be simultaneously charged in a charging capacitor Cc. One electrode of the charging capacitor Cc may be connected to the fifth transistor T5, and the other electrode thereof may be connected to a ground terminal GND. The fifth transistor T5 may be referred to as a sensing transistor.

Referring to FIG. 4B, in a sensing driving period, the fifth transistor T5 may be turned off by the second scan signal SCAN2. Accordingly, a voltage charged at node E connected to the source electrode or the drain electrode of the fifth transistor T5 can be discharged through the second data line DL2, and at this time, a threshold voltage of the light emitting element EL can be sensed. In other words, by reading a charging value charged in the charging capacitor Cc, variations in the threshold voltage of the light emitting element EL can be sensed. Referring to FIG. 2, by turning on the second switch element SW2 in the sensing driving period, the sensed voltage can be supplied from the second data line DL2 to the compensation circuit 142 of the timing controller 140.

In the sensing driving period, the first transistor T1, the second transistor T2, the third transistor T3, the fourth transistor T4, and the driving transistor DT may be turned off, and the light emitting element EL may not emit light.

The electroluminescent display device 100 may include a separate memory. An initial value of the threshold voltage of the light emitting element EL may be stored in the memory. Thereafter, a value of the threshold voltage of the light emitting element EL sensed through the sensing driving period can be compared with the initial threshold voltage of the light emitting element EL stored in the memory, and a voltage value corresponding to a variance in the threshold voltage of the light emitting element EL can be compensated for a corresponding data voltage Vdata in the sampling period ② in normal operation. Accordingly, the threshold voltage of the light emitting element EL can be compensated, and the sub-pixel P may emit light representing a desired luminance.

Meanwhile, since the sensing driving process of the sub-pixel P described in FIGS. 4A and 4B is performed through the transistors, noise resulting from characteristics of transistors may be included in the sensed voltage. Specifically, noise may be included in the sensed voltage due to a leakage current caused when the fifth transistor T5 is turned off. Accordingly, as a method for reducing noise due to a leakage current of the fifth transistor T5, there is provided a method of adjusting the second scan signal Scan2 supplied to the fifth transistor T5 in sensing operation. Hereinafter, a method of adjusting a level of a voltage of a gate signal supplied to the display panel 110 will be described.

Figure 5A:
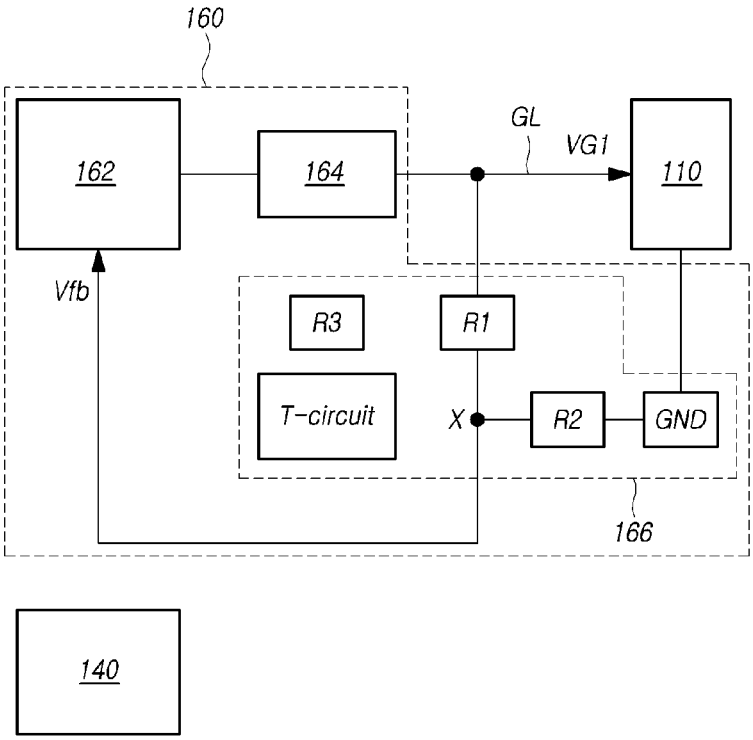
FIG. 5A is a block diagram for representing a path through which a voltage is applied to a display panel when the electroluminescence display device operates in normal operation according to aspects of the present disclosure.
Figure 5B:
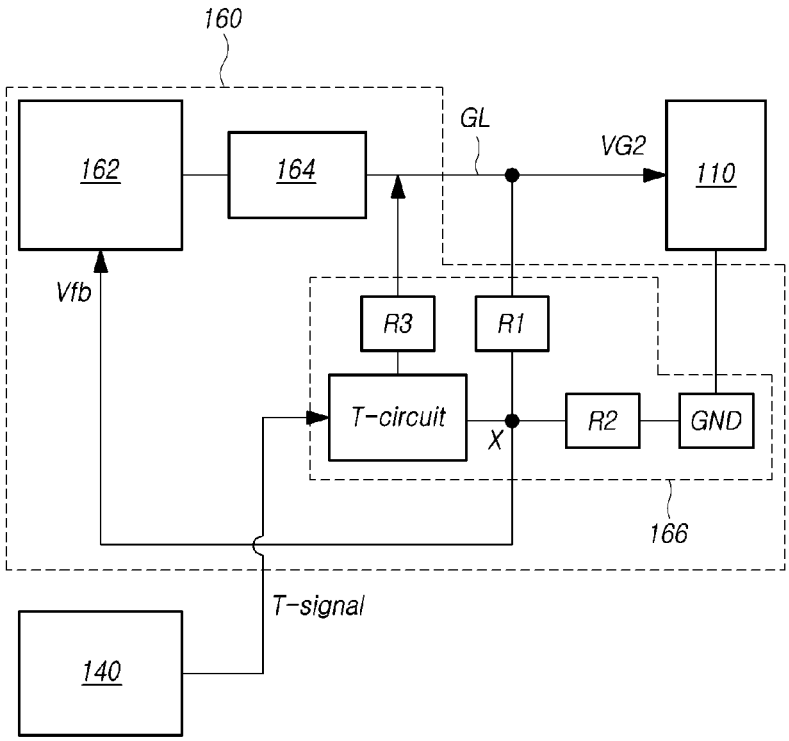
FIG. 5B is a block diagram for representing a path through which a voltage is applied to the display panel when the electroluminescence display device operates in sensing operation according to aspects of the present disclosure.

FIG. 5A is a block diagram for representing a path through which a voltage is applied to the display panel 110 when the electroluminescence display device 100 operates in normal operation according to aspects of the present disclosure. FIG. 5B is a block diagram for representing a path through which a voltage is applied to the display panel 110 when the electroluminescence display device 100 operates in sensing operation according to aspects of the present disclosure.

Referring to FIG. 5A, in normal operation, the display panel 110 receives a voltage required for driving the display panel 110 from the power supply circuit 160. The power supply circuit 160 illustrated in FIG. 5A represents circuit components that generate a gate low voltage VGL and a gate high voltage VGH for controlling turn-on and turn-off of a transistor. All of the gate low voltage VGL and the gate high voltage VGH may be referred to as "logic voltage VG". The logic voltage (VG or a gate voltage) may be supplied from the power supply circuit 160 to the display panel 110. In one embodiment, the logic voltage may be supplied to the display panel 110 via the level shifter 150 as shown in FIG. 1.

The power supply circuit 160 includes a power integrated circuit (IC) 162, a boost circuit 164, and a voltage regulator 166. The power IC 162 can convert power input to the electroluminescent display device 100 from the outside of the electroluminescent display device 100 into power suitable for driving drivers or driving circuits included in the electroluminescent display device 100, or maintain the input power or the converted power. The power IC 162 may be a semiconductor integrated device implemented as a single integrated circuit (IC). When the display device 100 is powered up, the power IC 162 increases an input voltage and outputs at least one logic voltage required by the timing controller 140 or the display panel 110. The power IC 162 may stably supply power even when there may occur variances in power input from the outside of the electroluminescent display device 100 and loads connected to an output terminal of the power IC 162.

One or more logic voltages VG may be applied to the timing controller 140 or a pixel driving circuit, and the logic voltages VG are required to be applied according to a power sequence determined by the timing controller 140 or the pixel driving circuit. To this end, a voltage supplied by the power IC 162 may pass through the boost circuit 164 including an inductor and a diode. The boost circuit 164 may include functions of a boost converter for step-up for suppling an output voltage with a level higher than an input voltage from the power IC 162 and a buck converter for step-down for supplying an output voltage with a level lower than the input voltage. Accordingly, the boost circuit 164 may regulate an output voltage of the power IC 162, thus supplying the adjusted voltage.

The voltage supplied by the boost circuit 164 may be applied to the display panel 110 through the voltage regulator 166. The voltage regulator 166 may include one or more resistors R1 and R2 and a ground terminal GND. In normal operation, an output voltage supplied by the boost circuit 164 may be adjusted to a logic voltage VG by passing through the resistors R1 and R2 and the ground terminal GND. In FIG. 5A, the first resistor R1 and the second resistor R2 are illustrated as the resistors; however, embodiments of the present disclosure are not limited thereto. When needed, two or more resistors may be included in the voltage regulator 166.

The logic voltage VG adjusted through the resistances R1 and R2 and the ground terminal GND may be supplied to the display panel 110 through a gate line GL, and at the same time, be fed back to the power IC 162, enabling the logic voltage VG to be re-configured. Specifically, the voltage regulator 166 may include node X shared by the first resistor R1 and the second resistor R2, and a voltage at node X can be fed back to the power IC 162. The voltage fed back to the power IC 162 may be referred to as "feedback voltage Vfb". The feedback voltage Vfb is supplied to the power IC 162 through a line connecting node X and the power IC 162. The logic voltage VG supplied to the display panel 110 from the power supply circuit 160 through the feedback voltage Vfb in normal operation may be referred to as "first logic voltage VG1" for convenience. In this situation, the first logic voltage VG1 is $$Vfb * \frac{R1 + R2}{R2}.$$

FIG. 5B illustrates a power supply circuit 160 for varying a logic voltage VG supplied to the display panel 110 in driving operations for sensing degradation of the display panel 110.

As described above, since the process of sensing a sub-pixel P can be performed through the fifth transistor T5, noise may be included in a sensed voltage due to a leakage current generated when the fifth transistor T5 becomes turned off. Since such noise is generated by the leakage current caused by the fifth transistor T5, it may be necessary to vary a logic voltage VG supplied to the fifth transistor T5 in order to reduce the leakage current of the fifth transistor T5.

In sensing operation of the display panel 110, the power supply circuit 160 can output a second logic voltage VG2, enabling the second logic voltage VG2 to be supplied to the display panel 110. As the second logic voltage VG2 is a value to which a difference of a threshold voltage of the light emitting element EL sensed through the fifth transistor T5 is reflected, the second logic voltage VG2 can prevent or reduce a leakage current of the fifth transistor T5.

An output voltage supplied from a power IC 162 may be supplied to the display panel 110 through a boost circuit 164 and a voltage regulator 166. In sensing operation, the second logic voltage VG2 can be adjusted through a circuit portion T-circuit and an auxiliary resistor R3 in addition to one or more resistors R1 and R2 and a ground terminal GND of the voltage regulator 166. In sensing operation, the timing controller 140 can supply a voltage control signal T-signal to the circuit portion T-circuit, and the circuit portion T-circuit controlled by the voltage control signal T-signal can change a logic voltage supplied from the boost circuit 164 to the second logic voltage VG2 through the resistors R1 and R2 and the auxiliary resistor R3. The voltage control signal T-signal supplied by the timing controller 140 to the circuit portion T-circuit may be a signal reflecting the amount of leakage current of the fifth transistor T5. A detailed circuit of the voltage regulator 166 will be described with reference to FIG. 6.

Figure 6:
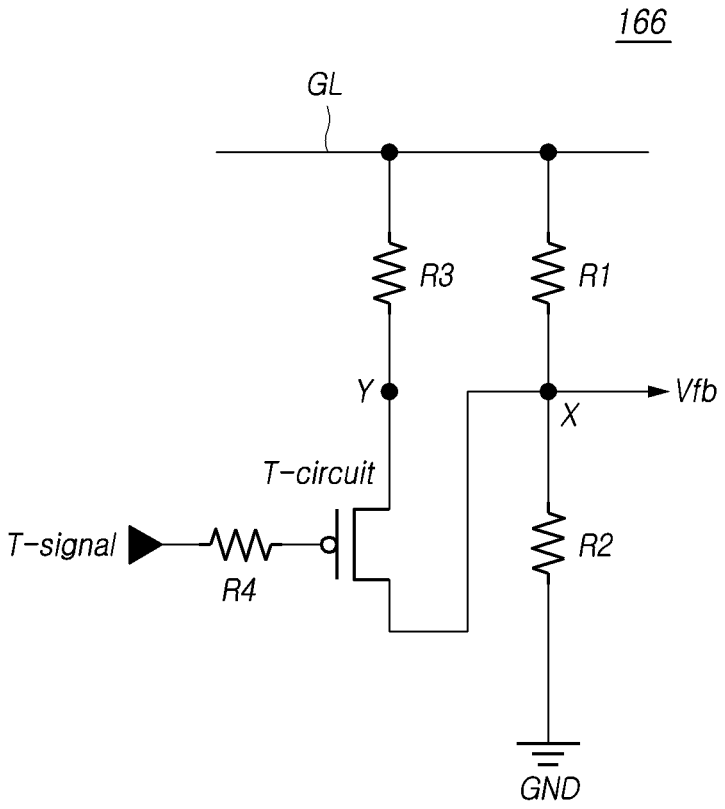
FIG. 6 is a circuit diagram illustrating a voltage regulator according to aspects of the present disclosure.

FIG. 6 is a circuit diagram illustrating the voltage regulator 166 according to aspects of the present disclosure.

The voltage regulator 166 may include resistors, an auxiliary resistor, and a circuit portion T-circuit. The resistors may include a first resistor R1 and a second resistor R2, and the auxiliary resistor may be a third resistor R3, and the circuit portion T-circuit may be implemented as one transistor.

One terminal of each of the first resistor R1 and the second resistor R2 may be connected to each other in series passing through node X. The other terminal of the first resistor R1 may be connected to a gate line GL, and the other terminal of the second resistor R2 may be connected to a ground terminal GND. One terminal of the third resistor R3 may be connected to the gate line GL together with the first resistor R1, and the other terminal thereof may be connected to node Y. Resistance values of the first resistor R1, the second resistor R2, and the third resistor R3 may be the same or different from one another.

The circuit portion T-circuit may be connected between node X and node Y. The source electrode and the drain electrode of a transistor included in the circuit portion T-circuit may be connected to node X and node Y, respectively, and the gate electrode of the transistor may be connected to a voltage control signal line to which a voltage control signal T-signal is supplied. The transistor may be controlled by the voltage control signal T-signal, enabling node X and node Y to be connected or disconnected. The transistor may be implemented as a P-type transistor or an N-type transistor. Although FIG. 6 illustrates that the circuit portion T-circuit is implemented as a P-type transistor; however, embodiments of the present disclosure are not limited thereto.

In sensing operation, the timing controller 140 transmits a voltage for turning on the transistor, which functions as a voltage control signal T-signal, to the circuit portion T-circuit. The transistor included in the circuit portion is turned on by the voltage for turning on the transistor, thus electrically connecting between node X and node Y. Accordingly, the first resistor R1 and the third resistor R3 may be connected in parallel, and the first resistor R1 and the second resistor R2 and the third resistor R3 and the second resistor R2 may be connected in series. An output voltage supplied from the boost circuit 164 can be adjusted into a second logic voltage VG2 by passing through the first resistor R1, the second resistor R2, and the third resistor R3, and the second logic voltage VG2 can be supplied to the display panel 110. As shown in FIG. 5B, a voltage at node X can be fed back to the power IC 162, enabling the adjusted voltage to be input to the display panel 110. In this situation, the second logic voltage VG2 is $$Vfb * \left(\frac{R1R3}{R2(R1 + R3)} + 1\right).$$

Further, by adding a fourth resistor to the gate electrode of the circuit portion T-circuit to delay a turn-on timing of the circuit portion T-circuit, it is possible to prevent or reduce noise that may be caused due to variations in voltages through the resistors R1 and R2 and the auxiliary resistor R3.

Figure 7:
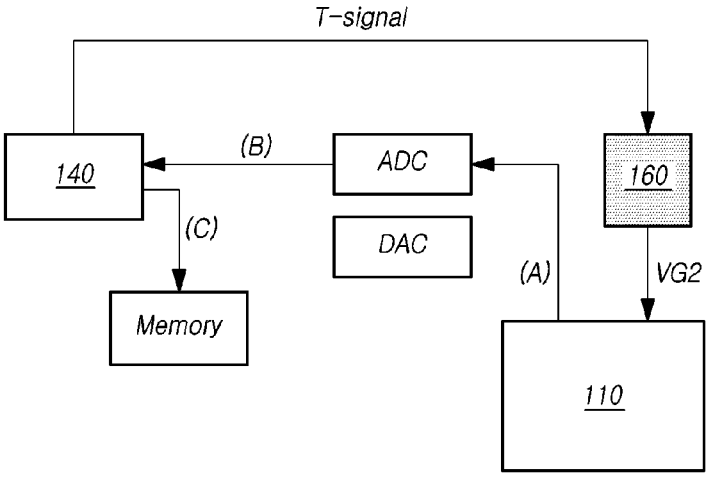
FIG. 7 is diagram for illustrating the driving of the electroluminescence display device in sensing operation according to aspects of the present disclosure.
Figure 8:
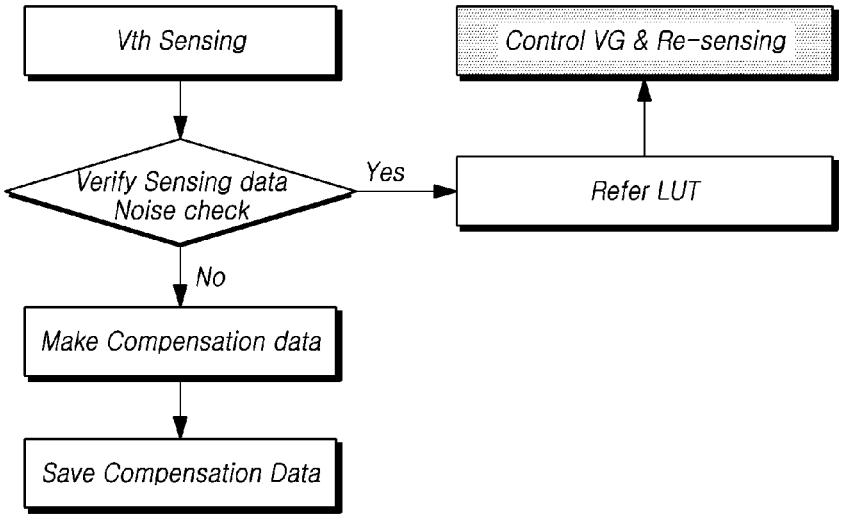
FIG. 8 is a flow chart illustrating a process for verifying noises by a timing controller when the electroluminescence display device operates in sensing operation according to aspects of the present disclosure.

FIG. 7 is diagram for illustrating the driving of the electroluminescence display device 100 in sensing operation according to aspects of the present disclosure. FIG. 8 is a flow chart illustrating a process for verifying noises by the timing controller 140 when the electroluminescence display device 100 operates in sensing operation according to aspects of the present disclosure.

A driving method of sensing degradation of one or more pixels included in the display panel 110 and adjusting a logic voltage VG by reflecting the sensed value may be repeatedly performed.

The display panel 110 can sense degradation of a light emitting element such as an organic light emitting diode in sensing operation, at step of Vth sensing. The sensed data can be transferred to an analog-to-digital converter ADC, through path (A), to convert the analog sensed voltage into digital sensed data. Then, the digital sensed data can be transmitted to the timing controller 140, through path (B).

The timing controller 140 can compare sensing data previously stored in a memory with the currently sensed data, and check a difference (noise) between the previously stored sensing data and the currently sensed data, at step Verify Sensing data Noise check. When there is a difference (noise) between the previously stored sensing data and the currently sensed data, the timing controller 140 can read a lookup-table LUT in which one or more logic voltages VG are stored, at step Refer LUT, and adjust a logic voltage stored in the lookup-table LUT in response to such a noise value, at step of Control VG. The adjusted logic voltage VG and a corresponding voltage control signal T-signal can be supplied to the voltage regulator 166. Further, the voltage regulator 166 can generate a second logic voltage VG2 by using the resistors R1 and R2, the auxiliary resistor R3, and supply the second logic voltage VG2 to the display panel 110, thus, enabling the display panel 110 to re-sense degradation of the light emitting element, at step of Re-sensing. The process of i) sensing degradation of a light emitting element, ii) determining noise by the timing controller 140, iii) adjusting a logic voltage VG according to the noise, iv) generating a second logic voltage VG2 by the voltage regulator 166, and v) re-sensing the degradation of the light emitting element by the display panel 110 using the second logic voltage VG2 may be repeated one or more times. Through the repeated processes, noise caused by the degradation of the light emitting element may be reduced, and thus, when a pixel circuit is driven, a degree to which the light emitting element is degraded can be accurately compensated.

When there is no difference (noise) between the previously stored sensing data and the currently sensed data, the timing controller 140 can generate compensation data and store the compensation data in a memory, through path (C), at step of Make Compensation data.

Electroluminescence display devices 100 according to aspects of the present disclosure can be described as follows.

In accordance with aspects of the present disclosure, an electroluminescence display device is provided that includes a display panel including a pixel driving circuit and a light emitting element, a power supply circuit for generating a logic voltage to be applied to the pixel driving circuit, and a timing controller for supplying a voltage control signal to the power supply circuit. The power supply circuit may include a power IC, a booster circuit, and a voltage regulator.

According to embodiments described herein, the voltage regulator may include one or more resistors and at least one transistor, and the transistor may be controlled by a voltage control signal and be connected between node X and node Y. The resistors may include a first resistor, a second resistor, and a third resistor. One terminal of the first resistor and one terminal of the second resistor may share node X and be connected to each other in series. The other terminal of the second resistor may be connected to a ground terminal, and the other terminal of the first resistor and one terminal of the third resistor may be connected to a line to which a logic voltage is supplied. A transistor may be connected between the other terminal of the third resistor and node X. Further, the voltage regulator may further include a fourth resistor connected to the gate electrode of the transistor. A feedback line may be included for feeding back a voltage at node X to the power IC.

According to embodiments described herein, the pixel driving circuit may be connected to the anode of the light emitting element, and includes a sensing transistor for sensing a threshold voltage of the light emitting element. The sensing transistor may be controlled by a logic voltage.

According to embodiments described herein, the display panel is driven through normal operation and sensing operation, and when in normal operation, a logic voltage supplied from a power supply circuit to the display panel is defined as a first logic voltage and in sensing operation, a logic voltage supplied from the power supply circuit to the display panel is defined as a second logic voltage, and the first logic voltage and the second logic voltage may be different from each other.

According to embodiments described herein, the display panel further includes a gate driver, and the logic voltage may be supplied to the gate driver. The logic voltage may be a gate high voltage.

The above description has been presented to enable any person skilled in the art to make and use the invention, and has been provided in the context of a particular application and its requirements. Various modifications, additions and substitutions to the described embodiments will be readily apparent to those skilled in the art, and the general principles defined herein may be applied to other embodiments and applications without departing from the spirit and scope of the present invention. Although the exemplary embodiments have been described for illustrative purposes, a person skilled in the art will appreciate that various modifications and applications are possible without departing from the essential characteristics of the present disclosure. For example, the specific components of the exemplary embodiments may be variously modified. The above description and the accompanying drawings provide an example of the technical idea of the present invention for illustrative purposes only. That is, the disclosed embodiments are intended to illustrate the scope of the technical idea of the present disclosure. Thus, the scope of the present disclosure is not limited to the embodiments shown, but is to be accorded the widest scope consistent with the claims. The scope of protection of the present disclosure is to be construed according to the claims, and all technical ideas within the scope of the claims should be interpreted as being included in the scope of the present invention.

What is claimed is:

1. An electroluminescence display device comprising:

a display panel comprising a pixel driving circuit and a light emitting element;

a power supply circuit for generating a logic voltage to be applied to the pixel driving circuit; and a timing controller for supplying a voltage control signal to the power supply circuit, wherein the power supply circuit comprises a power integrated circuit (IC), a booster circuit, and a voltage regulator, and wherein the pixel driving circuit comprises a sensing transistor for sensing a threshold voltage of the light emitting element, and a level of a voltage applied to a gate electrode of the sensing transistor in a period for sensing the threshold voltage of the light emitting element is different from a level of the voltage applied to the gate electrode of the sensing transistor in other period, wherein the level of the voltage applied to the gate electrode of the sensing transistor is adjusted according to noise determined based on a difference between a first threshold voltage of the light emitting element sensed at a first time and a second threshold voltage of the light emitting element sensed at a second time.

2. The electroluminescence display device according to claim 1, wherein the voltage regulator comprises a plurality of resistors and a transistor, and wherein the transistor is controlled by the voltage control signal and connected between node X and node Y.

3. The electroluminescence display device according to claim 2, wherein the plurality of resistors comprises a first resistor, a second resistor, and a third resistor, wherein one terminal of the first resistor and one terminal of the second resistor share the node X and are connected in series, and the other terminal of the second resistor is connected to a ground terminal, and the other terminal of the first resistor and one terminal of the third resistor are connected to a line to which the logic voltage is supplied, and wherein the transistor is connected between the other terminal of the third resistor and the node X.

4. The electroluminescence display device according to claim 3, wherein the voltage regulator further comprises a fourth resistor connected to a gate electrode of the transistor.

5. The electroluminescence display device according to claim 3, further comprising a feedback line for feeding back a voltage at the node X to the power IC.

6. The electroluminescence display device according to claim 1, wherein the pixel driving circuit is connected to an anode of the light emitting element.

7. The electroluminescence display device according to claim 1, wherein the sensing transistor is controlled by the logic voltage.

8. The electroluminescence display device according to claim 1, wherein the display panel is driven through normal operation and sensing operation, and when in the normal operation a first logic voltage is supplied from the power supply circuit to the display panel, and when in the sensing operation a second logic voltage is supplied from the power supply circuit to the display panel, the first logic voltage and the second logic voltage being different from each other.

9. The electroluminescence display device according to claim 1, wherein the display panel further comprises a gate driver, and the logic voltage is supplied to the gate driver.

10. The electroluminescence display device according to claim 9, wherein the logic voltage is a gate high voltage.

11. The electroluminescence display device according to claim 1, wherein the level of the voltage applied to the gate electrode of the sensing transistor in the period for sensing the threshold voltage of the light emitting element is lower than the level of the voltage applied to the gate electrode of the sensing transistor in other period.

12. The electroluminescence display device according to claim 1, wherein the level of the voltage applied to the gate electrode of the sensing transistor in the period for sensing the threshold voltage of the light emitting element is a level adjusted from the level of the voltage applied to the gate electrode of the sensing transistor in other period for reducing a leakage current through the sensing transistor.

13. The electroluminescence display device according to claim 1, wherein the sensing transistor is connected to an anode of the light emitting element.

* * * * *